US005256870A

United States Patent [19]

Raverdy et al.

[11] Patent Number: 5,256,870

[45] Date of Patent: Oct. 26, 1993

[54] INPUT SCREEN OF A RADIOGRAPHIC IMAGE INTENSIFYING TUBE HAVING A RADIALLY VARIABLE THICKNESS INTERMEDIARY LAYER

[75] Inventors: Yves Raverdy, Bas Bernin; Gérard Vieux, Grenoble; Francois Chareyre, St Egreve; Alain Tranchant, St Martin d'Heres, all of France

[73] Assignee: Thomson Tubes Electroniques, France

[21] Appl. No.: 840,770

[22] Filed: Feb. 24, 1992

[30] Foreign Application Priority Data

Aug. 31, 1990 [FR] France ..... 90 10870

[51] Int. Cl.[5] ..... H01J 31/50

[52] U.S. Cl. ..... 250/214 UT; 313/384; 313/375; 313/379

[58] Field of Search ..... 250/213 VT, 459.1, 327.2, 250/397, 484.1; 313/384, 375, 379, 377, 385, 386

[56] References Cited

U.S. PATENT DOCUMENTS 3,706,885 12/1972 Fister et al. ..... 250/459.1
3,716,713 2/1973 Levin ..... 250/213 VT
3,838,273 9/1974 Cusano ..... 250/213 VT
4,831,249 5/1989 Van der Velden et al. ..... 250/213 VT

FOREIGN PATENT DOCUMENTS 0378257 7/1990 European Pat. Off. .

*Primary Examiner*—David C. Nelms
*Assistant Examiner*—Que T. Le
*Attorney, Agent, or Firm*—Meltzer, Lippe, Goldstein

[57] ABSTRACT

An image intensifying tube, such as a image intensifying tube which converts X-rays into a visible image, comprises a curved input screen which comprises a substrate that receives input radiation and a photocathode supported on the substrate, and an output screen which converts the electrons emitted by the photocathode into a visible image. In order to compensate for changes in luminosity due to the curvature of the input screen, an intermediary layer of radially variable thickness is deposited between the substrate and the photocathode. The intermediary layer is made from a material, such as indium oxide ($In_2O_3$), which modifies the electron emitting characteristics of the photocathode as a function of the thickness the intermediary layer. Thus, a thicker intermediary layer near the center of the input screen will compensate for reduced luminosity at the edges of the screen.

9 Claims, 2 Drawing Sheets

INPUT SCREEN OF A RADIOGRAPHIC IMAGE INTENSIFYING TUBE HAVING A RADIALLY VARIABLE THICKNESS INTERMEDIARY LAYER

BACKGROUND OF THE INVENTION

This invention relates to an input screen of an image intensifying tube and in particular, but not exclusively, to an input screen of a radiographic image intensifying tube (RII tube).

Radiographic image intensifying tubes make it possible to transform a radiographic image into a visible image, generally for the purpose of medical observation.

Such tubes are vacuum tubes comprising an input screen, an electron-optical system and a display or output screen for observing a visible image.

The input screen comprises a scintillator which converts incident X-ray photons into visible photons which then excite a photocathode, generally made from an alkaline antimonide, e.g., cesium-doped potassium antimonide. The photocathode thus excited generates a flow of electrons.

The flow of electrons emitted by the photocathode is then transmitted by the electron-optical system which focuses the electrons and directs them onto the display screen comprising a luminescent substance which then emits a visible light. This light may then be processed, for example, by a television, cinematographic or photographic system.

In the most recent models of such tube, the input screen is comprised of an aluminum substrate covered by a scintillator. The scintillator is itself covered by an electrically conductive layer and which is also transparent to the light emitted by said scintillator. The scintillator may consist of indium oxide, for example. The photocathode is deposited on this transparent layer.

The X-rays strike the input screen on the aluminum substrate side, traverse this substrate, and then reach the material comprising the scintillator.

The luminous photons produced by the scintillator are emitted in substantially all directions. But, in order to increase the resolution of the tube, one chooses in general a substance for the scintillator material such as cesium iodide which has the characteristic feature of growing in the form of crystals that are perpendicular to the surface on which they are deposited. The needle-like crystals which are deposited in this fashion tend to guide the light perpendicularly to the surface, thus favoring good image resolution.

However, due to electron-optical factors, the surface of the input screen is not flat but convex; it may be parabolic or hyperbolic for screens of large dimensions, or, more usually, in the shape of a spherical dome for screens of smaller dimensions.

Due to this curvature of the screen, if the input screen is illuminated by a uniform beam of X-rays, the electron distribution engendered by the screen is not uniform. For example, one can measure the luminosity curve along the diameter of the output screen of the tube for a uniform X-ray illumination of the input screen: the luminosity curve shows the luminous intensity at each point on the diameter of the output screen. It should be noted that this curve is not horizontal; it is generally in the form of an arc of a circle somewhat flattened at the center; the luminosity of the output screen is at a maximum towards the center, but clearly decreases as it approaches the edges. In smaller tubes (15 cm diameter input screen, for example), the decrease of luminosity at the edges, in comparison with the center, is around 25%. In larger screens (30 cm in diameter, for example), the decrease approaches 35%.

It is one object of the invention to provide an image intensifying tube with a more uniform luminosity curve, i.e., one with a smaller spread between the luminosity at the center and the luminosity at the edges, in order to achieve uniform illumination of the input screen. Another object of the invention is to obtain this improved uniformity of luminosity by a simple method that is easier to implement on an industrial scale than the methods proposed in prior art.

Indeed, it may be noted that the prior art (e.g., Ep O 239 991) has already proposed to improve the uniformity of the luminosity by giving a non-uniform distribution to the thickness of the scintillator layer of the input screen. However, this prior art method is not easy to implement for the following reason: the efficiency of the scintillator increases and then decreases with the thickness; in order to obtain a satisfactory efficiency, it is necessary to start at the maximum level, but one is then on a plateau of the efficiency curve as a function of thickness, and therefore the thickness must be varied considerably in order to modify luminosity. From this it results that a high degree of uniformity in scintillator thickness must be maintained and this is industrially impractical, all the more because the scintillator is deposited in a very thick layer (on the order of 400 micrometers).

It should be noted that elsewhere in the prior art (e.g., EP A 0 378 257) it has been proposed to add a selectively absorbent layer between the scintillator and the photocathode. The function of this layer is to absorb light wavelengths emitted by the scintillator below a certain wavelength because these wavelengths are interfering, and to allow preferred wavelengths to pass freely to the photocathode. This layer may be of variable thickness so that the optical absorption at the center may be greater than the absorption at the edges. The greater absorption is due to the longer optical path to be traversed by the light rays emitted by the scintillator through this absorption layer. In order to obtain this effect, a thickness varying from 10 to 20 microns is indicated for the absorption layer.

SUMMARY OF THE INVENTION

It has now been shown according to the invention that the luminosity curve of an intensifying tube can be improved much more easily without modifying the thickness of the scintillator and without adding an absorbent optical layer, but rather by using certain very particular characteristics of a thin transparent underlayer deposited under the photocathode.

According to the invention, it is proposed that a thin intercalated layer with a radially variable thickness, made from a material which causes the electron emitting characteristics of the photocathode to be modified as a function of the thickness of that material, be deposited under the photocathode (in the case of an RII tube between the scintillator and the photocathode).

The present invention is based on the following observation made by the inventors: the photocathode is made from a chemically rather unstable material which will react with the underlayer on which it is deposited; this reaction will modify the emitting characteristics of the photocathode as a function of the thickness of the underlayer in cases where this thickness is minimal, i.e., in cases where it does not exceed a few hundred nanometers.

It was noted that the intercalation of a very thin, even transparent, intermediary layer between the scintillator and the photocathode would have direct consequences on the luminosity, and this as a function of the thickness of said intermediary layer. This effect is not the result of an optical absorption phenomenon, but of a partial chemical deactivation phenomenon of the photocathode which increases as the thickness of the underlayer increases so long as the thickness range of the intermediary layer does not exceed a few hundred nanometers.

The invention therefore proposes that a very thin intermediary layer of radially variable thickness be placed under the photocathode. This layer is preferably transparent; it is preferably conductive; its thickness is preferably less than a few hundred angstroms; it comprises, preferably, indium oxide.

This intermediary layer works with currently used photocathodes of cesium-doped potassium antimonide. These photocathodes are very reactive, especially as they are being deposited, because of the very high temperatures prevailing in the region in which this deposit takes place. They are highly reducing and react strongly with oxidizing substances.

For example, if a layer of indium oxide ($In_2O_3$) which has the property of being at the same time conductive and transparent and which is therefore sometimes used as a conductive underlayer before the deposit of the photocathode, is intercalated between the scintillator layer and the photocathode, it has been shown according to the invention that the final luminosity of the intensification tube depends to a great extent on the thickness of the indium oxide layer. This dependency is much greater than that which results from the simple (negligible) optical absorption characteristics of this layer. This is why it is especially advantageous to give this layer a radially variable thickness in order to modify the luminosity curve as desired. It is very likely that this variation of luminosity is due to a chemical reaction between the indium oxide and the alkaline antimonide of the photocathode; such reaction tends to decompose a quantity of the antimonide that is linked to the quantity of indium oxide, i.e., to the thickness of the indium oxide layer. This chemical reaction occurs during the photocathode depositing phase.

Here again a greater thickness at the center of the intermediary layer will be provided in order to reduce the effectiveness of the photocathode. The order of magnitude of the thickness of the intermediary layer is preferably as follows: approximately 250 angstroms at the edges and 400 angstroms at the center.

BRIEF DESCRIPTION OF THE DRAWINGS

Other characteristics and advantages of the invention will become evident from the detailed description which follows and which is given with reference to the attached drawings, in which.

DETAILED DESCRIPTION OF THE INVENTION

Figure 1:
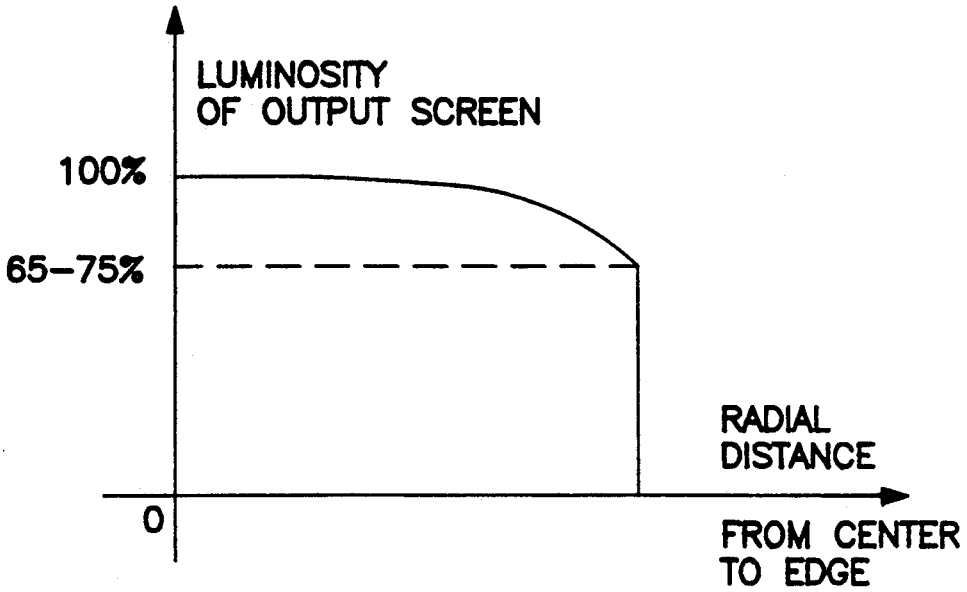
FIG. 1 shows a luminosity curve of an RII tube of the prior art.

FIG. 1 shows a classic luminosity curve of an image intensification tube, recorded with respect to the diameter of the output screen: it represents the luminosity of a line formed by points of the image visible on the output screen as a function of the distance of these points to the center of the screen, assuming that the illumination of the input screen is uniform. In the case of an RII tube, the illumination is a uniform beam of X-rays.

The abscissa represents the radial distance to the center and the ordinate represents the luminosity of the visible output image. It can be seen that the luminosity curve is not at all a straight horizontal line or almost one, as might be theoretically desirable; it is rather a kind of arc of a circle flattened towards the center. The difference in luminosity between the edges and the center ranges from 25% to 35% depending on tube types and diameters. In reality, a certain difference in luminosity may be desirable, but not one that is as high as that.

Figure 2:
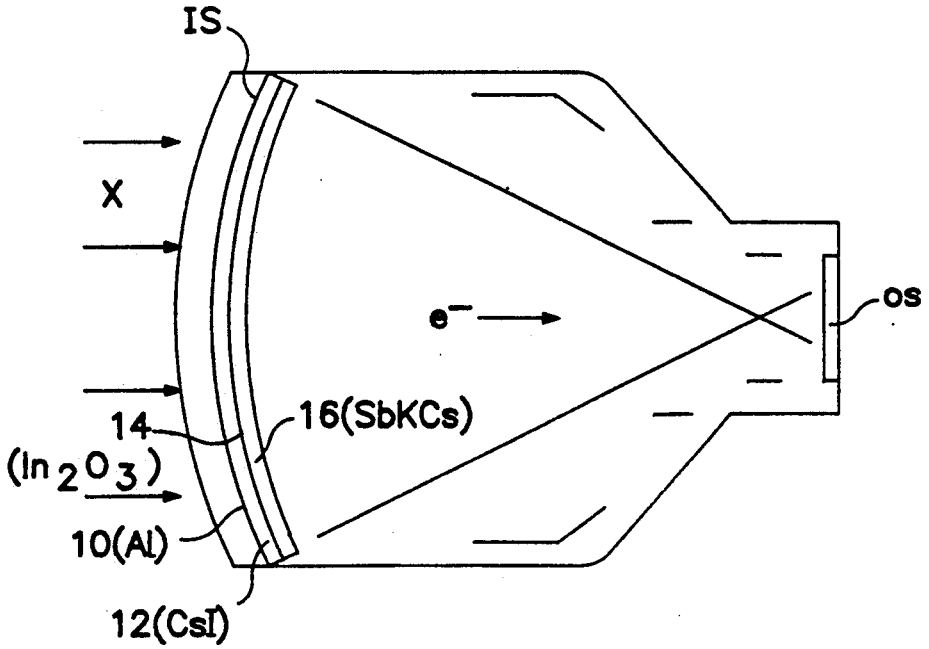
FIG. 2 PRIOR ART
FIG. 2 shows the general structure of an RII tube according to the prior art.

The general structure of a classic radiographic image intensifier is shown in FIG. 2. The enclosure of the vacuum tube contains an input screen IS at the front and an output screen OS at the back. Electrodes for focusing of electron beams are provided within the enclosure.

The input screen is most often convex in a parabolic or hyperbolic form with a strong curvature for reasons of electron-optics, i.e., in order to allow for uniform focusing of the electrons on the output screen. This curvature is one of the reasons for the shape of the luminosity profile of the tube.

The input screen IS generally comprises a convex aluminum sheet 10 on which a scintillating layer 12 (cesium iodide with a thickness of several hundred micrometers) is deposited and which is itself covered by a transparent conductive electrode 14 (generally made from indium oxide $In_2O_3$) and then a photocathode 16 (which can be made of potassium antimonide and cesium, for example).

The purpose of the transparent conductive electrode (14) is to fix the potential of the photocathode uniformly.

According to the invention it is proposed that an intermediary layer between the scintillating layer and the photocathode (a layer which can be the conductive transparent electrode 14 itself) be deposited with a thickness that is radially variable from the center to the edges, this intermediary layer being selected from a material that modifies the electron emitting characteristics of the photocathode as a function of the thickness of the intermediary layer.

Figure 3:
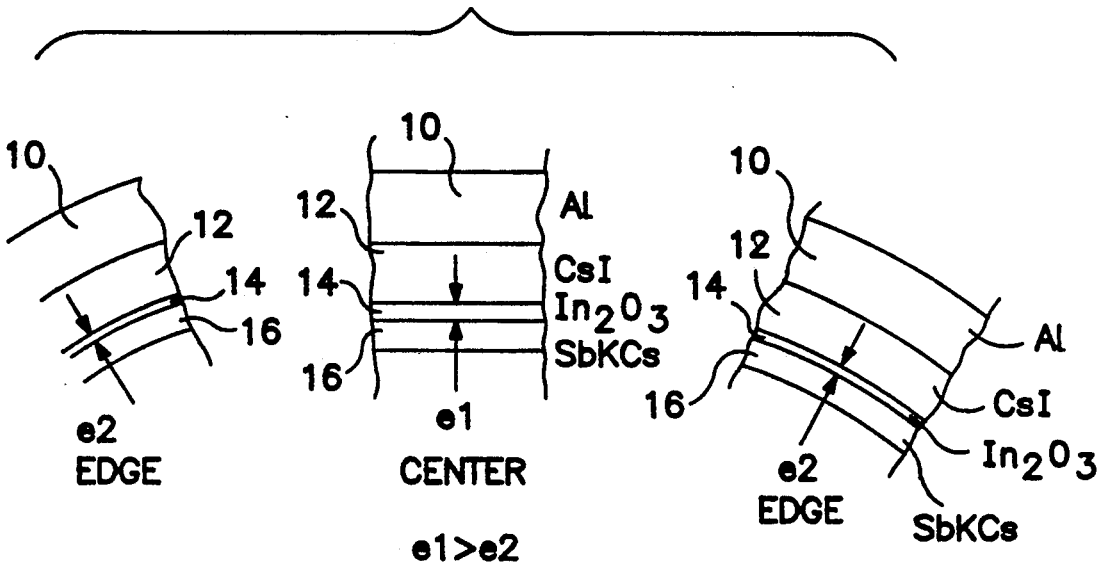
FIG. 3 shows the structure of the layers of an input screen of an RII tube according to the invention.
Figure 4:
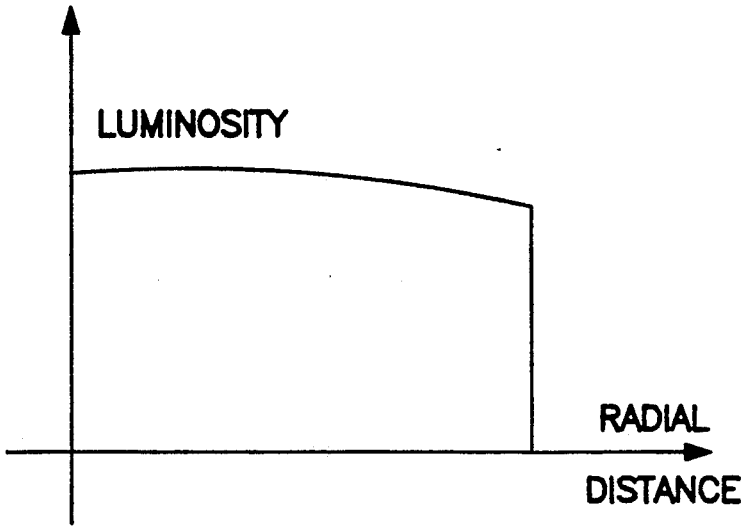
FIG. 4 shows a luminosity curve of an RII tube according to the invention.

The screen structure which implements the invention in the simplest manner is shown in FIG. 3: the intermediary layer is simply a layer of indium oxide used as the transparent conductive electrode 14 under the photocathode 16. As can be seen in FIG. 3, the thickness of the intermediary layer varies radially. It is greater (thickness e1) at the center of the screen than at the edges (thickness e2) because it has been found that an increase of thickness of the layer 14 causes a reduction of the luminosity. As demonstrated in FIG. 4, the excessive curvature of the luminosity curve of FIG. 1 is thus compensated for. The variation of the thickness of the layer 14 is essentially continuous from the center to the edges.

The deposit with variable thickness is effected in a known manner through evaporation in the presence of a mask which rotates in front of the surface to be covered, the configuration of the mask being defined as a function of the thickness profile to be obtained. Thicknesses are on the order of a few hundred angstroms.

It has been found that a thickness varying between approximately 400 angstroms (at the center of the screen) and approximately 250 angstroms (at the edges) was entirely suitable. It is interesting to note that the variation in optical absorption due to this variation in thickness is entirely negligible. Nevertheless the luminosity of the screen is compensated for to the desired extent (it is easy for example to go from a difference of 25% to a difference of 10% from the center to the edges). It therefore seems that the indium oxide layer acts mainly through a reduction of the photocathode's emitting capacity, and this action depends to a great extent on the indium oxide thickness.

It is possible to choose materials other than the stoichiometric indium oxide $In_2O_3$ as the intermediary layer 14. Indium oxide partially reduced to $In_xO_y$ with a thickness on the order of a few hundred angstroms can also be used. Other metal oxides, such as tin oxide (SnO), indium-tin oxide, and zinc oxide (ZnO) are also suitable for the intermediary layer. The thickness variation should be of the same order of magnitude as with stoichiometric indium oxide.

In the case of a visible image intensifying tube and not a radiographic image intensifier, no scintillator is employed and a material such as indium oxide, the thickness of which determines the final luminosity is deposited on a substrate before depositing the photocathode.

While the invention has been described by reference to specific embodiments, this was for purposes of illustration only and should not be construed to limit the spirit or the scope of the invention. Numerous alternative embodiments will be apparent to those skilled in the art and are considered to be within the scope of the invention.

We claim:

1. An image intensification tube, comprising a curved input screen which comprises a substrate which receives input radiation and a photocathode supported on said substrate, said photocathode emitting electrons when illuminated, and an output screen which converts said electrons into a visible image, said input screen further including an intermediary layer located between said substrate and said photocathode, said intermediary layer having a radially variable thickness, said intermediary layer being made from a transparent material which modifies the intrinsic electron emitting characteristics of said photocathode as a function of the thickness of said intermediary layer so that variations in the luminosity of the output screen are compensated for by the radially variable thickness of the intermediary layer.

2. The tube of claim 1 wherein said intermediary layer is thicker near the center of said input screen than near the edges of said input screen.

3. The tube of claim 1 wherein the thickness of said intermediary layer is on the order of several hundred angstroms.

4. The tube of claim 1 wherein the thickness of said intermediary layer varies in the range of about 250 angstroms to about 400 angstroms.

5. The tube of claim 1 wherein said intermediary layer is made from a metal oxide.

6. The tube of claim 1 wherein said intermediary layer is made from stoichiometric indium oxide ($In_2O_3$).

7. The tube of claim 1 wherein said intermediary layer is made from partially reduced indium oxide ($In_xO_y$).

8. The tube of claim 1 wherein said intermediary layer is made from tin oxide, indium-tin oxide or zinc oxide.

9. The tube of claim 1 wherein said tube is a radiographic image intensification tube and wherein said input radiation comprises X-rays, said input screen further including a scintillating layer located between said substrate and said intermediary layer.

* * * * *